US008206225B2

(12) United States Patent
Voelker et al.

(10) Patent No.: US 8,206,225 B2
(45) Date of Patent: Jun. 26, 2012

(54) SYSTEM AND METHOD FOR FORMING INTERDICTION DEVICE

(75) Inventors: Jeffrey J. Voelker, Butler, PA (US); Michael J. Vilcheck, Butler, PA (US); David Greenwald, Pittsburgh, PA (US)

(73) Assignee: The Boeing Company, Chicago, IL (US)

( * ) Notice: Subject to any disclaimer, the term of this patent is extended or adjusted under 35 U.S.C. 154(b) by 987 days.

(21) Appl. No.: 12/191,022

(22) Filed: Aug. 13, 2008

(65) Prior Publication Data

US 2010/0285909 A1 Nov. 11, 2010

(51) Int. Cl.
*A63F 9/24* (2006.01)

(52) U.S. Cl. ..... 463/46; 463/53

(58) Field of Classification Search ..... 463/49, 463/46, 51–54

See application file for complete search history.

(56) References Cited

U.S. PATENT DOCUMENTS

| | | | |
|---|---|---|---|
| 5,654,423 | A | 8/1997 | Kahl et al. |
| 5,654,523 | A | 8/1997 | Brunn |
| 6,253,680 | B1 | 7/2001 | Grubelich |
| 6,767,108 | B1 | 7/2004 | Blachowski et al. |
| 7,220,957 | B2 | 5/2007 | Choi et al. |

OTHER PUBLICATIONS http://en.wikipedia.org/wiki/Grenade#Stud_grenades, 3 pages.

*Primary Examiner* — Omkar Deodhar

(74) *Attorney, Agent, or Firm* — Harness, Dickey & Pierce, P.L.C.

(57) ABSTRACT

A reusable interdiction apparatus that makes use of a housing of dimensions making the housing suitable to be carried and thrown by an individual. A light source is disposed within the housing and adapted to project an optical signal through a portion of the housing. A controller is used for controlling operation of the light source. A power source is disposed within the housing and used for powering the controller and the light source.

20 Claims, 3 Drawing Sheets

SYSTEM AND METHOD FOR FORMING INTERDICTION DEVICE

FIELD

The present disclosure relates to interdiction devices and methods, and more particularly to a non-lethal interdiction device that can be re-used.

BACKGROUND

The statements in this section merely provide background information related to the present disclosure and may not constitute prior art.

Interdiction devices such as non-lethal hand grenades, for example the M84 Stun Grenade, generally take the form of incendiary devices that are thrown or shot into a designated area. Such devices typically use a chemical mixture that is detonated. These devices are limited in that once the chemicals are detonated, they are depleted and the device is spent. The chemical bi-product of the exothermic reaction used to generate the effect, while non-hazardous, nevertheless produces smoke that can limit the operations of friendly forces in the area where the device has been deployed.

Furthermore, the use of such conventional, incendiary devices in confined areas is often limited, particularly when these areas may contain volatile substances, which would give rise to a risk of secondary explosions. Thus, situations frequently exist where it is not possible or advisable to use an incendiary type interdiction device.

SUMMARY

In one aspect the present disclosure pertains to a reusable interdiction apparatus. The apparatus may comprise: a housing of dimensions making the housing suitable to be carried and thrown by an individual; a light source disposed within the housing and adapted to project an optical signal through a portion of the housing; a controller for controlling operation of the light source; and a power source disposed within the housing for powering the controller and the light source.

In another aspect the present disclosure relates to a reusable interdiction apparatus that may comprise: a housing made of an impact resistant material, and having dimensions making the housing suitable to be carried and thrown by an individual; a high intensity light emitting diode (LED) light source disposed within the housing and adapted to project an optical signal through a portion of the housing; a controller for controlling operation of the light source; an acoustic device for emitting a high intensity acoustic signal from the housing, and the acoustic device being controlled by the controller; and a power source for powering the controller, the LED light source and the acoustic device.

In still another aspect the present disclosure relates to a method for forming a reusable interdiction apparatus. The method may comprise: providing a housing suitable to be thrown and carried by an individual; disposing a high intensity light source within the housing such that the light source is able to emit a high intensity light signal through at least one opening in the housing; using a controller disposed within the housing to control the high intensity light source; and using a power source to power the controller and the high intensity light source.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
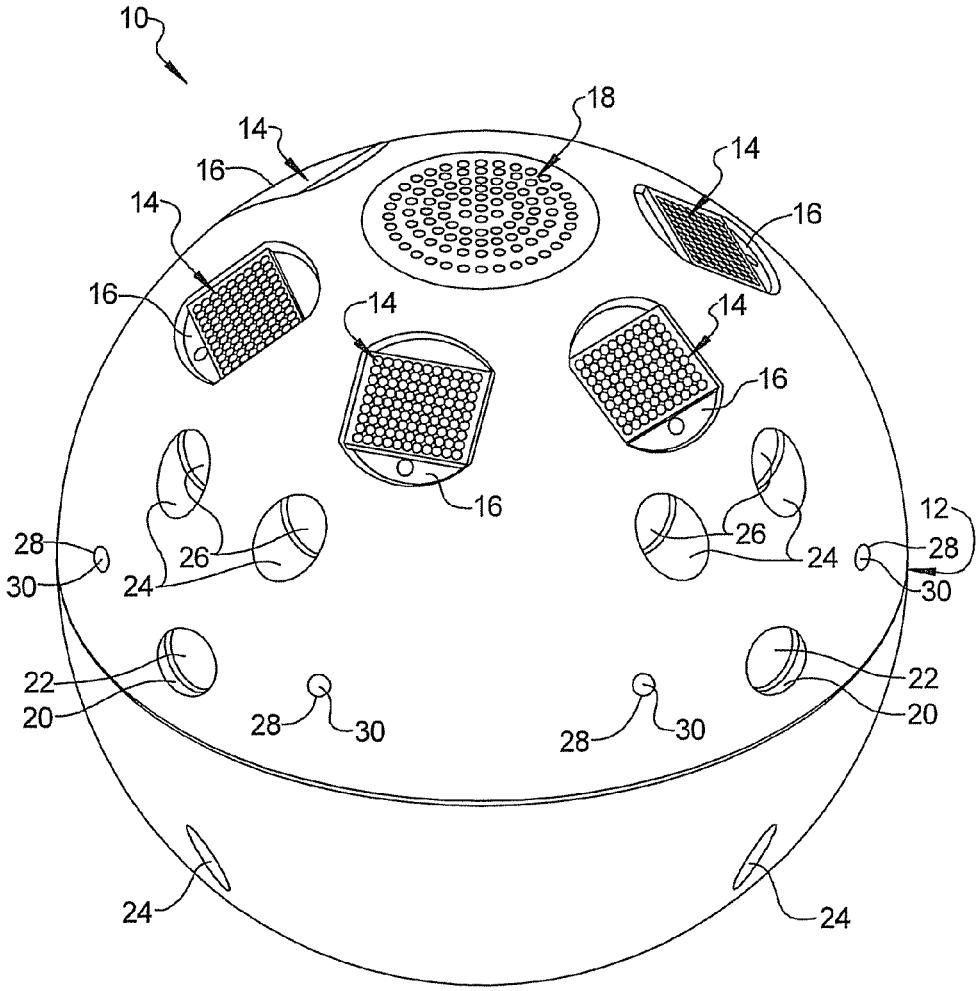
FIG. 1 is an elevational view of an apparatus in accordance with one embodiment of the present disclosure.

Referring to FIG. 1 there is shown one embodiment of an interdiction apparatus 10 in accordance with the present disclosure. The apparatus 10 may include a housing 12 formed in any suitable shape that is convenient for an individual to handle. In this example the housing 12 is formed as a sphere, but other shapes such as squares, rectangles, pyramids, etc. may be employed. The housing 12 may be formed as a two piece (or possibly three or more piece) shell-like structure from high impact polycarbonate or carbon polymer material that is resistant to impacts. Other materials are usable provided same are relatively light in weight and able to survive an impact without breaking. This enables the housing 12 to be thrown by an individual or even potentially launched from an external tool such as a tear gas canister launcher. The housing 12 is of external dimensions that enable it to be easily handled, carried and/or thrown by a single individual. In various embodiments the housing 12 preferably has a diameter of typically between about 4-10 inches (102 mm-254 mm) and weighs preferably less than about five pounds (2.27 kg).

The housing 12 includes at least one high intensity light source, for example a high intensity light emitting diode (LED) array 14, and more preferably a plurality of LED arrays 14 spaced circumferentially around the housing 12. While only the upper half of the housing 12 is shown in FIG. 1 as having the LED arrays 14, it will be appreciated that the lower half of the housing could just as readily include an additional LED array or arrays spaced circumferentially around the lower half. Each of the LED arrays 14 are positioned within a respective opening 16 in the housing 12 so that the optical signals generated by the LED arrays 14 can be projected therefrom without interference by the housing 12. The precise number of LEDs arrays 14 used may vary considerably, but in one example may be between four to six such arrays per hemisphere of the housing 12. The number of LEDs included within each LED array 14 may also vary widely to suit the needs of a particular application, but in many instances it is expected that between about 25-150 LEDs will be suitable for forming each one of the LED arrays 14. As will be explained further in the following paragraphs, each LED array 14 can emit continuous or pulsing light signals with a programmed repetition rate that significantly disrupt the ability of an individual in the vicinity of the apparatus 10 to see and optically navigate in areas close to the apparatus 10

The housing 12 may also include one or more groups of smaller clustered apertures 18 that are suitably dimensioned for enabling acoustic signals to pass therethrough. Still another plurality of openings 20 are arranged circumferentially around the housing 12 to enable one or more internal video or still cameras 22 to be housed within the housing 12 and be able to provide video or still picture information pertaining to activity in the vicinity of the housing 12. Another plurality of openings 24 may be provided in the housing to enable optional acoustic sensors, such as microphones 26, to pick up audio information present in the vicinity of the apparatus 10. Openings 28 may be used to enable at least one motion sensor 30, and more preferably a plurality of such motion sensors, to be arranged to detect motion occurring in the vicinity of the apparatus 10.

The above components and sensors have been described as enabling the monitoring or detection of activity within a "vicinity" of the apparatus 10. It will be appreciated that the "vicinity" will be a range or area around the apparatus 10 that will depend on the sensitivity and capabilities of the specific monitoring/imaging components used in the apparatus 10. Obviously, more sensitive components may extend the vicinity around the apparatus 10 within which effective monitoring/surveillance may be performed, but at the additional cost required by more sensitive components. Also, it will be appreciated that the specific arrangement of the various sensing/surveillance components shown in FIG. 1 is merely illustrative of one specific embodiment. The various sensing/surveillance components employed within the apparatus 10 could be arranged on the housing 12 in other patterns or configurations to suit specific applications. Furthermore, various subcombinations of surveillance/monitoring components could be employed to meet the needs of specific applications.

Figure 2:
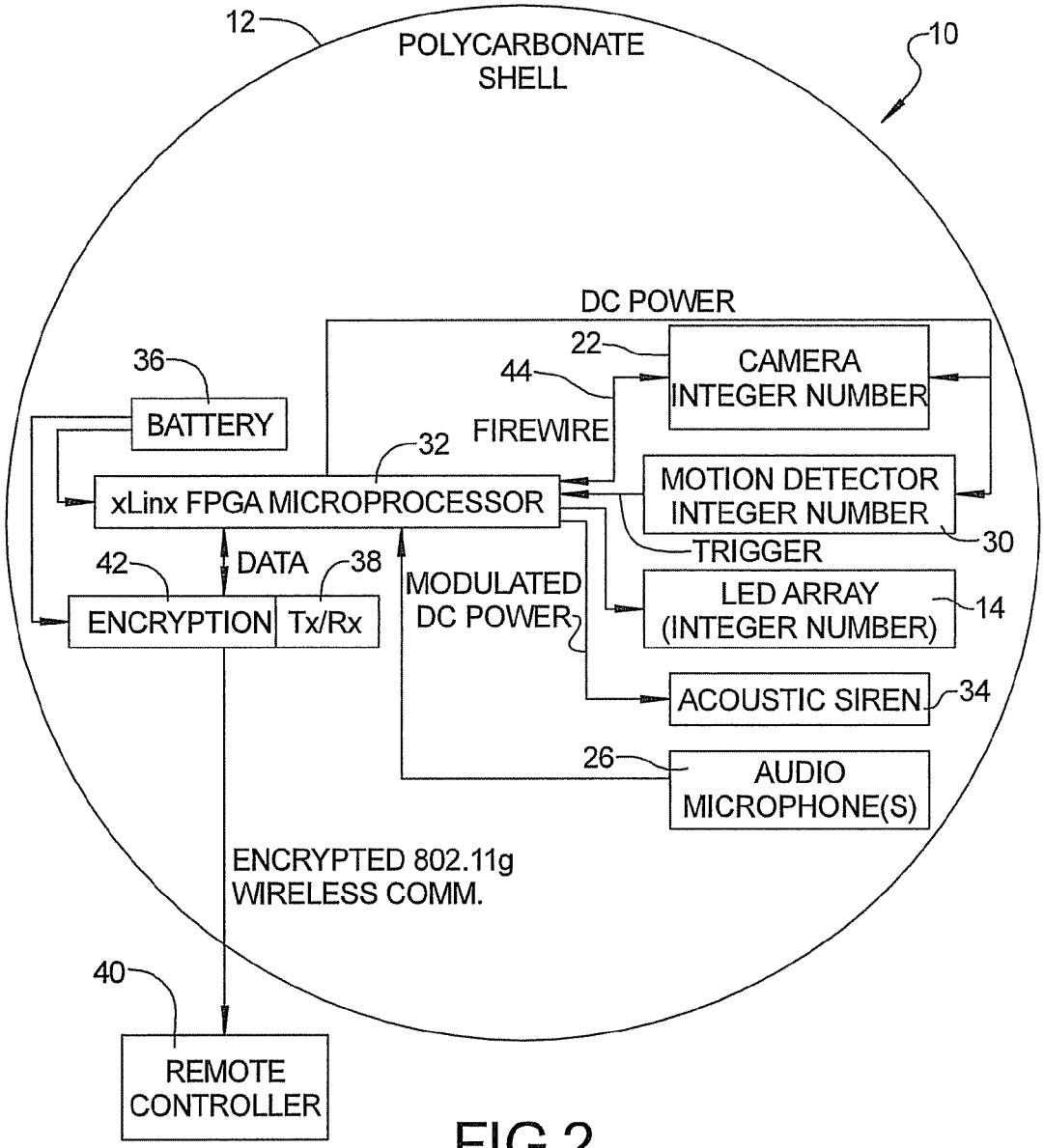
FIG. 2 is block diagram of the apparatus of FIG. 1 illustrating various internal components that may be used in forming the apparatus.

Referring to FIG. 2 a block diagram of the apparatus 10 is shown. The apparatus 10 also may include a controller, such as a Field Programmable Gate Array (FPGA) microprocessor 32 for controlling operation of each of the LED arrays 14. The microprocessor 32 may also be used to control an acoustic device, such as an acoustic siren 34, that emits high intensity audio signals through the openings 18 in the housing 12. The acoustic signals from the acoustic siren 34 may be of a magnitude, for example 120 dB in sound level, that significantly disrupts the ability of individuals in the vicinity of the apparatus 10 to carry on conversations and/or causes significant physical ear pain to an individual not wearing any form of ear protection. The audio signals may be continuous or intermittent at a frequency and repetition rate controlled by the microprocessor 32.

Still further the microprocessor 14 may be used to control operation of the camera or cameras 22 and the motion detector or detectors 30. A battery 36 may be used to provide DC power to power the apparatus 10, although it will be appreciated that any suitable power source may be employed for this purpose. For example, direct methanol fuel cells or electric double layer capacitors (i.e., "ultracapacitors") could also be used as power sources.

With further reference to FIG. 1, the microprocessor 32 may also be in communication with a transmitter, or more preferably a transmitter/receiver (i.e., transceiver) 38. The transceiver 38 may be used to facilitate two way wireless communications between the apparatus 10 and a remote controller 40. In this example the remote controller 40 is located at some location remote from the apparatus 10, for example at a central base station. The transceiver 38 may also include an encryption subsystem 42 for encrypting information sent from the transceiver 38 and for decrypting information sent to the transceiver 38 from the remote controller 40. Any suitable communications protocol may be used between the transceiver 38 and the remote controller 40, for example the 802.11g wireless communication standard.

The microprocessor 32 may be coupled to the camera or cameras 22 by a suitable interface 44, for example an IEEE 1394 interface, or possibly PC/104, HSSI, USB, PCI or PCI/X interfaces. The microprocessor 32 may be in communication with the motion detector or detectors 30 so that it can be apprised by a signal (or signals) from one or more of the motion detectors 30 as to when motion has been sensed in the vicinity of the apparatus 10. The microprocessor 32 may also be used to control operation of the LED arrays 14 to control the frequency and/or intensity of the light signals emitted by the LED arrays 14. The microprocessor 32 may optionally also be used be used with beam forming optics (not shown) to provide even greater control over the pattern or distribution of light emitted from the LEDs in each LED array 14. The LED arrays 14, when operating, make it difficult for an individual to visually navigate towards the apparatus 10.

Figure 3:
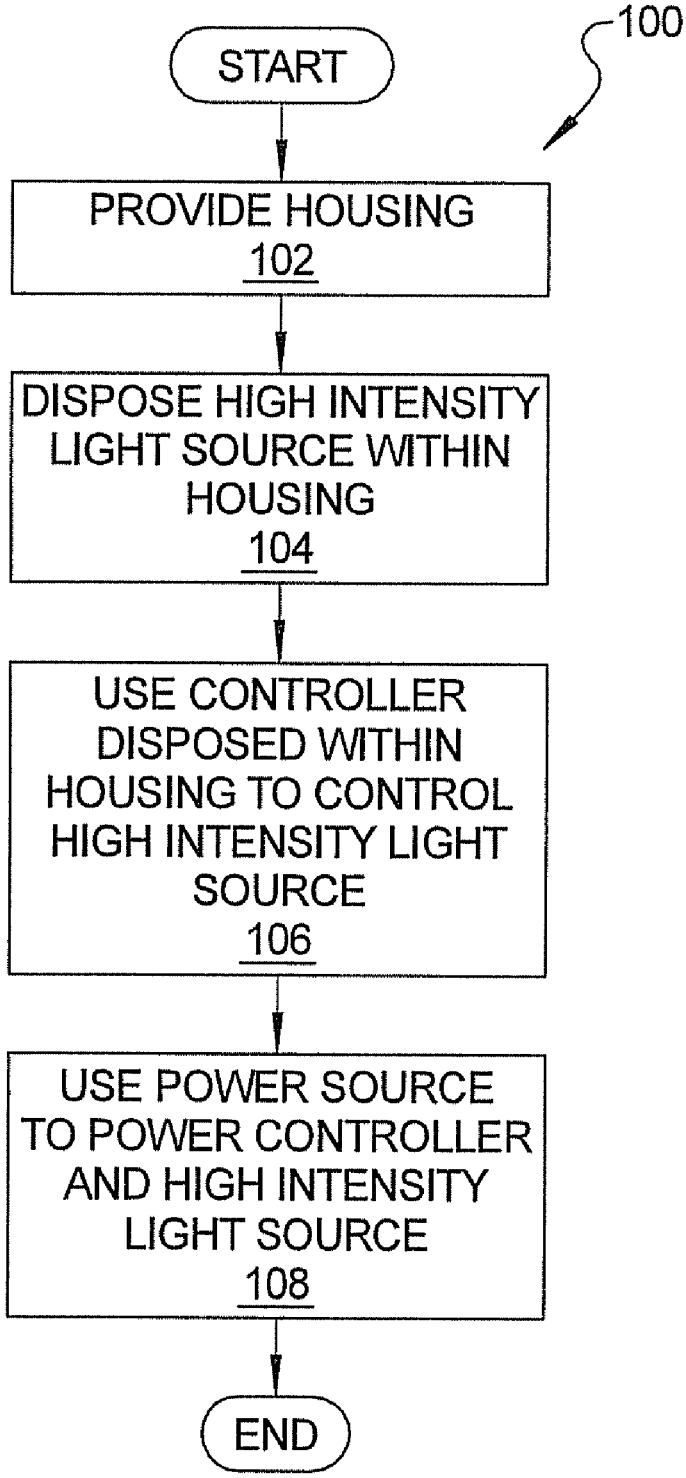
FIG. 3 is a flowchart setting forth various operations in forming and using one embodiment of the apparatus of the present disclosure.

Referring to FIG. 3 a flowchart 100 of a method for forming and using the apparatus 10 is shown. At operation 102 the housing 12 is provided. At operation 104 at least one high intensity light source, such as at least one LED array 14, is provided within the housing 12. At operation 106 a controller, for example microprocessor 32, is used to control operation of the light source so that high intensity light signals are generated therefrom. At operation 108 a power source, for example battery 36, is used to provide power to the controller and the high intensity light source.

It is a principal advantage of the apparatus 10 that it is reusable. By providing a reusable interdiction device, the cost of implementing such a device is significantly reduced. Previously developed interdiction devices have traditionally been of the incendiary type where the device is essentially destroyed or rendered inoperable after one use.

The apparatus 10 also provides the advantage that because of its compact dimensions and relatively light weight, it can be easily thrown by an individual, or alternatively launched from a suitable launching device, into an area where interdiction is needed. The durable construction of the housing 12 prevents damage to the internal components of the apparatus 10 when the apparatus 10 impacts a surface such as a floor surface, a wall surface, a ground surface or another object or structure. Since the apparatus 10 does not make use of any incendiary components, there is virtually no risk of the apparatus 10 causing a secondary fire or explosion when used in areas where explosives or flammable materials are present. Thus, the apparatus 10 is expected to use in those situations where a traditional incendiary type interdiction device would not be useable.

The apparatus 10, since it is relatively compact, may also be left in an area and activated remotely by wireless signals from the remote controller 40. Alternatively, the microprocessor 32 may be programmed to allow the apparatus 10 to sit in a "sleep" mode with only a select number of internal components powered on, until motion or an audio signal is detected. At that point the microprocessor 32 may power on all, or a select subset, of the internal components of the apparatus 10 to make use of all or a select subset of interdiction/monitoring/surveillance capabilities of the apparatus 10. Alternatively, the microprocessor 32 may be programmed to power on all or a limited subset of the internal components of the apparatus 10 at a specific day and time.

The microprocessor 32 may also be programmed to interrupt power to certain ones of the internal components in a specific order to conserve battery power and maximize the time duration that the apparatus 10 can be operated on a single battery or battery charge. For example, if it is expected that audio monitoring may be most important in a given application, the microprocessor 32 may be programmed to shut down battery power to the still or video camera(s) 22 when the battery power drops to a predetermined level. In this regard it will be appreciated that the microprocessor 32, or some other suitable component, will need to be used to monitor the level of remaining battery power available from the battery 36. Power to other components could be interrupted in successive steps as available battery power drops.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A reusable interdiction apparatus comprising:

a housing of dimensions making the housing suitable to be carried and thrown by an individual;

a light source disposed within said housing and adapted to project an optical signal through a portion of said housing;

a motion detector disposed within said housing for detecting motion of an individual within a proximity of said apparatus;

a controller for controlling operation of said light source and said motion detector; and a power source disposed within said housing for powering said controller and said light source.

2. The apparatus of claim 1, wherein the apparatus further comprises an acoustic device disposed within said housing for emitting an acoustic signal from said housing.

3. The apparatus of claim 1, further comprising a camera disposed within said housing, and including an optical element in communication with a opening in said housing, for providing an optical image of an area in a vicinity of said apparatus.

4. The apparatus of claim 3, further comprising a wireless transmitter for transmitting a wireless signal from said camera to a remote location.

5. The apparatus of claim 4, wherein said wireless signal comprises an encrypted wireless signal.

6. The apparatus of claim 1, wherein said power source comprises a battery.

7. The apparatus of claim 1, wherein said housing comprises at least one of a polycarbonate spherical shell and a carbon polymer spherical shell.

8. The apparatus of claim 1, wherein said light source comprises at least one high intensity light emitting diode (LED).

9. The apparatus of claim 1, wherein said light source comprises an array of high intensity light emitting diodes (LEDs).

10. The apparatus of claim 2, wherein said acoustic device comprises a frequency selectable acoustic siren.

11. The apparatus of claim 2, wherein the apparatus weighs no more than about five pounds.

12. A reusable interdiction apparatus comprising:

a housing made of an impact resistant material, and having dimensions making said housing suitable to be carried and thrown by an individual;

a high intensity light emitting diode (LED) light source disposed within said housing and adapted to project an optical signal through a portion of said housing;

a controller for controlling operation of said light source;

a frequency selectable acoustic siren for emitting a high intensity acoustic signal from said housing, and said acoustic siren being controlled by said controller; and a power source for powering said controller, said LED light source and said acoustic siren.

13. The apparatus of claim 12, wherein said housing comprises at least one of a polycarbonate spherical shell and a carbon polymer spherical shell.

14. The apparatus of claim 12, further comprising a motion detector housed within said housing and in communication with said controller, said controller adapted to energize said high intensity LED light source and said acoustic siren upon receipt of a signal from said motion detector indicating that motion of an object has been detected.

15. The apparatus of claim 12, further comprising a surveillance camera disposed within said housing and in optical communication with an opening in said housing, said camera adapted to generate an output signal representative of an image of a predetermined area in a vicinity of said housing.

16. The apparatus of claim 15, wherein said output signal comprises an encrypted output signal.

17. The apparatus of claim 12, further comprising a wireless transmitter disposed within said housing and in communication with said controller for transmitting information provided by said controller to a remotely located controller.

18. The apparatus of claim 12, further comprising a wireless transceiver disposed within said housing for providing two way wireless communications between said controller and a remote controller.

19. A method for forming a reusable interdiction apparatus, the method comprising:

providing a housing suitable to be thrown and carried by an individual;

disposing a high intensity light source within said housing such that said light source is able to emit a high intensity light signal through at least one opening in said housing;

using a controller disposed within said housing to control said high intensity light source;

using a power source to power said controller and said high intensity light source; and using a motion detector placed within housing to detect motion within a vicinity of said housing.

20. The method of claim 19, further comprising the operation of using a high intensity acoustic device placed within said housing to emit a high intensity acoustic signal through at least one opening in said housing.

* * * * *